United States Patent [19]

DiIanni

[11] 3,930,592

[45] Jan. 6, 1976

[54] BEER CAN STRUCTURE

[75] Inventor: Daniel DiIanni, Toronto, Canada

[73] Assignee: Carling O'Keefe Limited, Toronto, Canada

[22] Filed: Dec. 23, 1974

[21] Appl. No.: 535,693

[30] Foreign Application Priority Data

Jan. 7, 1974 United Kingdom ..... 00718/74

[52] U.S. Cl. ..... 220/270; 220/DIG. 16; 215/7; 116/70; 116/114 C

[51] Int. Cl.[2] ..... B65D 41/32

[58] Field of Search .... 220/66, 1 BC, 270, DIG. 16; 215/7; 116/70, 72, 114 C

[56] References Cited

UNITED STATES PATENTS

| | | | |
|---|---|---|---|
| 2,027,430 | 1/1936 | Hansen | 220/66 |
| 3,152,711 | 10/1964 | Mumford et al. | 215/7 UX |
| 3,664,543 | 5/1972 | Brown et al. | 220/270 |

*Primary Examiner*—George T. Hall
*Attorney, Agent, or Firm*—Sim & McBurney

[57] ABSTRACT

A can structure suitable for packaging beer or the like includes an indicator formed integral with one end wall. The indicator provides visual, tactile and audible indication of the quality of the product in the can. Various specific indicator structures are disclosed.

5 Claims, 4 Drawing Figures

BEER CAN STRUCTURE

FIELD OF INVENTION

This invention relates to a beer can structure.

BACKGROUND TO THE INVENTION

Beer is commonly packaged in openable sealed cans which are under an internal pressure of the carbon dioxide in the beer. Leaks sometimes develop in such cans causing loss of carbon dioxide, resulting in "flat" beer in the cans. However, it is not readily apparent to the consumer whether the beer is fresh and sparkling or stale and flat without opening of the can. Can leaks do not usually provide an externally visible trace of the same. A similar problem may arise with any carbonated drink packaged in a can and the present invention also is applicable thereto.

SUMMARY AND GENERAL DESCRIPTION OF INVENTION

The present invention provides a beer can structure having an indicator device associated therewith providing a visual, tactile and audible indication whether or not the contents of the can are under pressure. In accordance with the present invention, a flexible zone is provided in one end wall of the can and integral therewith. The flexible zone or portion is constructed to be sufficiently flexible to have at least a portion thereof projected from the surface of the end wall wherein it is situated when the can is under at least a predetermined internal minimum pressure. When the pressure in the can falls below the predetermined minimum pressure, the flexible zone or portion moves to a second position in which it is all located below or at the level of the end wall.

Typically, the indicator includes a resiliently biasable portion which under can depressurized conditions, has a rest position, but which under the influence of at least the predetermined internal pressure is moved to its resiliently biased positon.

The integral flexible portion of the end wall of the can, typically an alumimum can, therefore, provides both a visual and tactile indication to the consumer whether or not the beer in the can is under the correct pressure, and hence whether the beer is fresh or flat.

Thus, if the flexible portion is in its rest position below or at the level of the end wall, then the consumer will immediately observe by visual and/or tactile means, the unsatisfactory nature of the product. However, if the flexible portion is raised, the consumer will immediately recognize that the product is in its consumable state.

An audible indication of the product quality also may be provided by the present invention. Thus, upon opening of the can and thereby release of the internal pressure, if the can is correctly pressurized, then an audible click may sound, depending on the construction of the flexible portion, as the flexible portion immediately moves from its resiliently-biased position to its rest position. On the other hand, in such constructions, there will be no audible click if the pressure has already leaked away, thereby warning the consumer who may have failed to observe visually or tactilely, the depressed nature of the flexible portion.

The flexible zone or portion conveniently is provided in the same end closure as the can opening means, which typically is a ring pull tab opener. By such positioning, the consumer will be able to observe the condition of the flexible portion immediately prior to opening the can.

The flexible portion generally has a circular disc-like form and is provided integral with the end of the can. The flexible portion may be provided with the required resiliency in the can end in any convenient manner.

DESCRIPTION OF PREFERRED EMBODIMENTS

Figure 1:
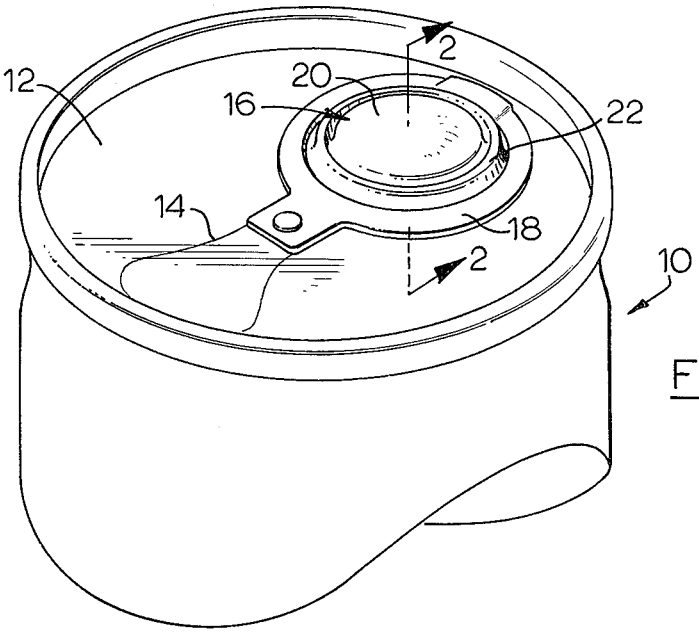
FIG. 1 is a general perspective view of a beer can embodying the invention.

A beer can 10, typically of cylindrical shape and having upper and lower end closure walls sealing the can. One of the end closure walls 12 has formed therein a typical ring-and-tab opener 14 for gaining access to the contents of the can 10. In the end closure wall 12 also is formed an integral indicator means 16, typically substantially circular. As illustrated, the circular indicator 16 is surrounded by the ring 18 of the ring-and-tab opener 14, for easy detection by the consumer prior to pulling of the ring.

Figure 2:
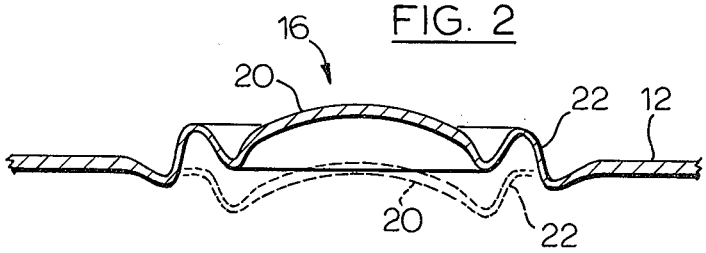
FIG. 2 is a sectional view of a portion of a beer can in accordance with one embodiment shown in full outline in a first resiliently-biased position and in phantom outline in a second rest position.
Figure 3:
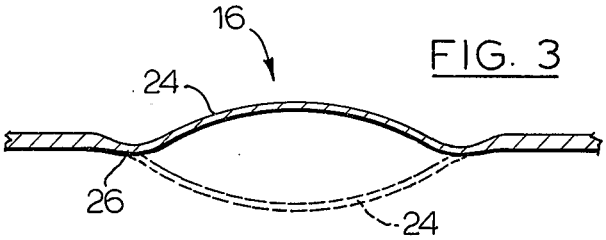
FIG. 3 is a sectional view of a portion of a beer can in accordance with a second embodiment shown in full outline in a first convex position and in phantom outline in a second concave position.
Figure 4:
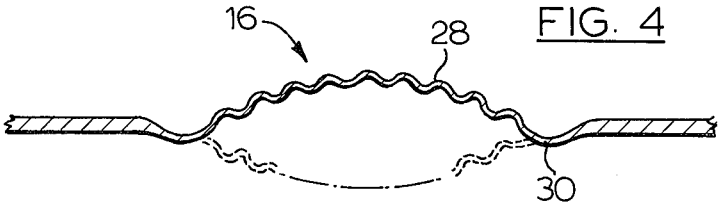
FIG. 4 is a sectional view of a portion of a beer can in accordance with a third embodiment of the invention with both positions illustrated.

Several different forms of the indicator 16 are illustrated in the sectional views of FIGS. 2 to 4. As seen in FIG. 2, the indicator 16 includes an inner circular dished portion 20 which may be flexible or stiff as desired, and a serpentine cross section annular flexible portion 22 integral with and joining the inner portion 20 with the remainder of the end wall 12.

The serpentine portion 22 is generally elastic and may be resiliently-biased under the influence of internal gas pressure on the inner portion 20 from a rest position to a resiliently-biased position. As may be seen from a comparison of FIG. 2, under normal pressure conditions, which for lagers in Canada under refrigeration (34°F) is about 12 to 16 psi and at room remperature (70°F) is about 35 psi, the inner portion 20 is projected outwardly of the surface of the wall 12 due to resilient flexing of the annular portion 22 under the influence of the internal pressure. However, when the pressure drops below the predetermined pressure, typically below about 12 psi, the external pressure and resilience in the annular portion 22 cause it to snap to the released or rest position, drawing the inner portion 20 downwardly to the level of or slightly below the surface of the wall 12, as seen in phantom outline.

In the embodiment of FIG. 3, the indicator 16 takes the form of a flexible disc 24 which is formed integral with the remainder of the wall 12 through a resiliently-biasable peripheral portion 26. When the can contents are under normal pressure, typically about 14 to 17 psi for ales in Canada at refrigeration (34°F) and about 35 psi at room temperature (70°F), the disc 36 is resiliently outwardly-convexly projected as seen in full outline. If the internal pressure drops below a predetermined value, typically below 12 psi, the disc 24, under the biasing action of the peripheral portion 26, snaps to an inwardly-concave rest position, as seen in phantom outline.

It will be apparent that release of pressure from the can 10 by opening the ring-and-tab opener 14 also will cause the indicator 16 to assume its released position, with an audible click, at least in the case of the embodiment of FIG. 3, as the disc 24 snaps from the convex to the concave position.

FIG. 4 illustrates a third embodiment of indicator 16. In this case, the indicator 16 is formed of a series of concentric integrally-joined corrugations 28, joined to the remainder of the wall 12 through an annular resilient portion 30. The indicator 16 of this embodiment operates in substantially the same manner as the embodiment of FIG. 3.

SUMMARY

The present invention, therefore, provides a pressurized can structure having a novel indicator means whereby the consumer may readily detect whether or not the can is under its correct internal pressure. Modifications are possible within the scope of the invention.

What I claim is:

1. A sealed can structure including a cylindrical wall member, end wall members located substantially at each end of said cylindrical wall member and sealing said can, a potable liquid located within the can structure and intended in its potable condition to exert at least a predetermined gaseous pressure of about 12 psi internally of said can, a tab formed integral with but separable from one of said end wall members, a pull ring having a substantially circular opening and joined to said tab for separating said tab from said one end wall member and gaining access to the contents of said can, and integrally-formed indicator means in said one end wall member, said indicator means being substantially disc-like and being located at least partially within the circular opening in said pull ring, said indicator means being constructed to assume one position relative to the remainder of said end wall member when said internal pressure exceeds said predetermined pressure of about 12 psi and to assume a second position relative to the remainder of said one end wall when said internal gaseous pressure is below said predetermined pressure of about 12 psi through opening of said can or through leakage of gas pressure from an unopened can, said second position being usually and tactilely different from said first position, whereby external examination of said can in the immediate vicinity of the tab and pull-ring for said can reveals whether or not said internal pressure has fallen below said predetermined value of about 12 psi and hence whether or not pressure leakage has occurred.

2. The can structure of claim 1 wherein said indicator means includes a first central circular portion dished outwardly of the said one end wall member and a second annular portion integrally joining said central portion to the remainder of said one end wall member, said second annular portion having a serpentine cross section and being resiliently-biased in said first position for movement to said second position when the internal pressure of said can falls below said predetermined value, said first central portion outwardly projecting from the remainder of said one end wall member in said first portion and being located substantially at the level of or below that of said one end wall member in said second positon.

3. The can structure of claim 1 wherein said indicator means includes a flexible dished disc integrally formed with and joined to the remainder of said one end wall member through a resiliently-biasable peripheral portion thereof, said disc being resiliently biased in said first postion for movement to said second position when the internal pressure of said can falls below said predetermined value, said disc being dished convexly outwardly of the remainder of said one end wall member in said first position and being dished concavely inwardly of the remainder of said one end wall member in said second position.

4. The can structure of claim 1 wherein said indicator means includes a flexible circular member formed of a series of concentric integrally-joined corrugations joined to the remainder of said one end wall member through an annular resilient portion, said circular member being resiliently biased in said first position for movement to said second position when the internal pressure of said can falls below said predetermined value, said circular member projecting convexly outwardly of the remainder of said one end wall member in said first position and projecting concavely inwardly of the remainder of said one end wall member in said second position.

5. The can structure of claim 1 wherein said potable liquid is beer.

* * * * *